US005797144A

United States Patent [19]

Ciccone

[11] Patent Number: 5,797,144

[45] Date of Patent: Aug. 25, 1998

[54] NECK TOWEL AND ADJUSTABLE CLASP

[76] Inventor: Michael James Ciccone, 3519 Bigelow Blvd., Pittsburgh, Pa. 15213

[21] Appl. No.: 9,537

[22] Filed: Jan. 20, 1998

[51] Int. Cl.[6] ..... A41D 27/00; A41D 23/00

[52] U.S. Cl. ..... 2/144; 2/91; 2/145; 2/207; D2/609; D2/600; D2/607; 63/15.4

[58] Field of Search ..... 2/91, 144, 145, 2/146, 147, 148, 149, 150, 151, 152.1, 153, 154, 155, 156, 157, 207, 1; 63/3, 6, 15, 15.4, 15.5; D2/600, 601, 602, 603, 604, 605, 606, 607, 608

[56] References Cited

U.S. PATENT DOCUMENTS

| | | |
|---|---|---|
| D. 179,199 | 11/1956 | Kiraly . |
| 816,231 | 3/1906 | Hill et al. . |
| 866,752 | 9/1907 | Way . |
| 1,936,045 | 11/1933 | Bachrach . |
| 2,042,442 | 5/1936 | Buchman . |
| 2,870,448 | 1/1959 | Rosenthal . |
| 2,939,150 | 6/1960 | Rosenthal . |
| 3,183,612 | 5/1965 | Romaine . |
| 3,439,360 | 4/1969 | Grubman . |
| 3,748,661 | 7/1973 | Smith . |
| 3,894,296 | 7/1975 | Hirschbeck . |
| 3,999,222 | 12/1976 | Walborn . |
| 4,038,724 | 8/1977 | Parizek . |
| 5,035,002 | 7/1991 | Knight, Jr. . |
| 5,291,616 | 3/1994 | Lamons et al. . |
| 5,454,121 | 10/1995 | Mellinger . |
| 5,493,731 | 2/1996 | Amnott . |

*Primary Examiner*—Jeanette E. Chapman

[57] ABSTRACT

A towel of predetermined shape and an adjustable clasp to be worn by a human being around the neck and of the type having a towel (10) of predetermined length and width and whose perimeter is covered on both surfaces with fabric binding (12) that is sewn in place with conventional thread stitching. The adjustable clasp is comprised of a pliable material of predetermined length and width that is wrapped in a circle of predetermined diameter to form inner band (26) which is encircled by outer band (27) and at conjunct (30) inner band end (26A), outer band end (27A), and transitional segment (25) are bonded together. The clasp is fastened to the towel by passing one end of the towel into the inner band and the other end of the towel into the outer band and this fastening forms neck band section (22) which is positioned around the neck and can be reduced or enlarged by moving the clasp up or down the towel section that is comprised of the combined wipe area bottom (20) and wipe area top (18).

2 Claims, 6 Drawing Sheets

NECK TOWEL AND ADJUSTABLE CLASP

BACKGROUND—FIELD OF INVENTION

This invention relates to a wearable towel and adjustable clasp assembly that is worn around the neck and is used to wipe perspiration from the face.

BACKGROUND—DESCRIPTION OF PRIOR ART

It is quite common to see sports enthusiasts and professional athletes alike wearing a towel draped around the neck. During vigorous activity the athlete must inconveniently hold the towel in place, yet the discomfort of having sweat drip down the face and into the eyes justifies such actions.

In fitness centers where towels are dispensed as part of the service, quests are encouraged to use their towel to wipe off any sweat that has fallen onto equipment. This same towel is typically used to wipe the face and hands, thus bacteria and debris can readily enter the body through mucous membrane surrounding the eyes. Fitness centers usually dispense white towels so all towels look alike. This practice increases the possibility that when a towel is set down it can be mistakenly picked up and used by someone other than its original recipient, thus spreading germs.

Inventors have neglected to fill what appears to be an obvious need for a wearable towel that stays in place and is convenient and comfortable to wear while exercising. Adjustable neck wear structures heretofore devised and utilized are known to consist basically of familiar, expected and obvious structural configurations, not withstanding the myriad designs encompassed by the crowded prior art which have been developed for the fulfillment of countless objectives and requirements.

Many accessories and necktie designs have been developed to offer alternative knotting arrangements and adjustments, but none have addressed the retention and adjustment requirements surrounding a neck towel that can be comfortably worn while exercising.

Known prior art body covering structures include U.S. Pat. Nos. 5,493,731; 5,035,002; 3,748,661. While these devices fulfill their respective, particular objectives and requirements, none are intended for active sports wear and ease of adjustment using a pliable clasp in combination with a specially-shaped towel. The aforementioned patents are representative of inventions that utilize intricate clasps, yet none disclose a pliable clasp that is effective, simple and easy to manufacture.

U.S. Pat. No. 5,493,731 to Amnott (1996) is intended to simulate a knotted necktie and as such its clasp consists of a solid shape with Y or U shaped branched bored holes which configure the necktie. This device would not be effective in combination with a neck towel as the simulated knot would have to be enlarged to cumbersome proportions in order to engage the two lengths of the towel. The clasp's trapezoidal profile and angled split bore require considerable fabrication, casting or injection molding processes, thus making the manufacturing and assembly costly. The rigid shape is ideally suited for novelty use where caricatures and graphics can be displayed on the surface of the trapezoidal profile. The Amnott invention is a simulated necktie and as such its benefits are directly related to how effectively it meets this simulation objective. Use of a towel with this device would defeat this objective as the size of the knot would grow to unrealistic proportions. U.S. Pat. No. 5,035,002 to Knight, Jr. (1991) comprises a clasp that is intended to simulate a knot on a necktie or scarf. Use of this device with a neck worn towel would necessitate a much larger and cumbersome shape. U.S. Pat. No. 3,748,661 to Smith (1973) includes a single circular ring clasp that retains a specially shaped scarf. This single rigid ring configuration is adequate for use with an adornment item such as a scarf, but with vigorous activity this ring clasp would slip down the length of the scarf.

Necktie and scarf accessories and apparel for these accessories heretofore known by the inventor suffer from a number of disadvantages:

(a) The design of the clasp accessories is limited to use with fabric materials that are relatively light in weight and density.

(b) Existing accessories are intended to simulate a knotted tie or a traditional scarf presentation that gathers the material close to the neck.

(c) Existing clasps, if used with a towel fabric for retaining and adjusting the towel's lengths, would have to be enlarged to a size that would be cumbersome to wear while participating in rigorous activity.

(d) Existing accessories require a rigid material for encircling or compressing the necktie or scarf and unless tapered these devices will not stay in position while engaged in rigorous activity, but this requirement forces design of the accessory to become large and cumbersome to wear.

OBJECTS AND ADVANTAGES

Objects and advantages of the present invention are:

(a) to provide a wearable neck towel that stays in place and can be efficiently used to wipe sweat from the face and hands.

(b) to provide a durable wearable neck towel that can be cost-effectively manufactured which will enable competitive pricing of the product.

(c) to provide a wearable neck towel that can be quickly adjusted by the wearer.

(d) to provide a wearable neck towel that is comfortable and does not restrict body movement.

(e) to provide an easy-to-use wearable towel that can be made in a variety of colors.

Further objects and advantages are to provide a convenient and adjustable neck towel assembly that stays fixed in place when engaged in rigorous activities. Still further objects and advantages will become apparent from a consideration of the ensuing description and drawings.

DRAWING FIGURES

In the drawings where it is obvious that exactly alike parts are being presented and where distinction is not necessary to describe the manufacture or operation, only a representative sample of the parts are numbered. Alphabetic suffixes are used along with a previously numbered part to disclose additional details of that part.

Figure 6A:
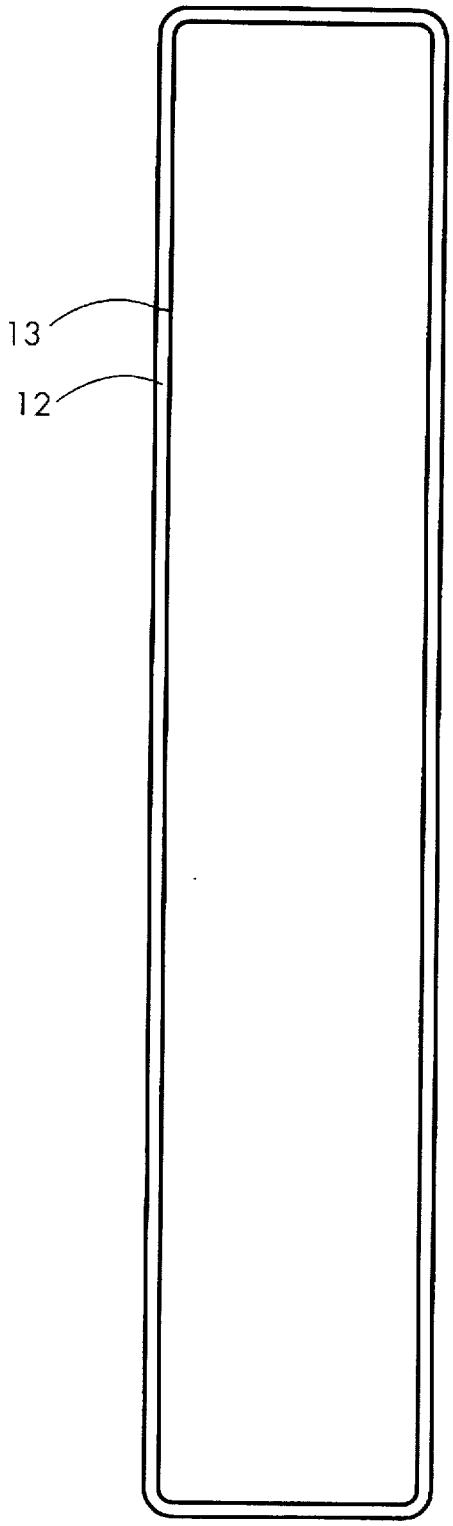
Figure 6B:
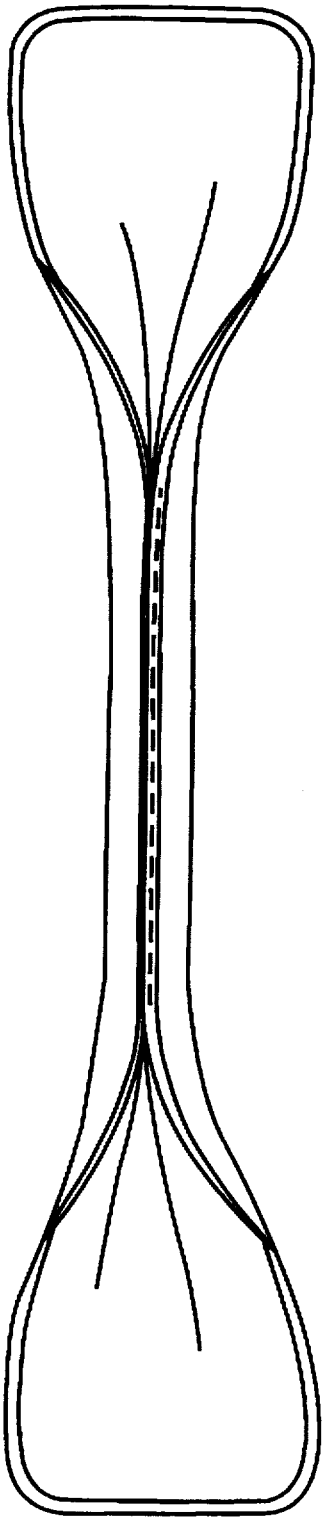

FIG. 6B hows a top view of another embodiment of a neck towel 6A.

Figure 7A:
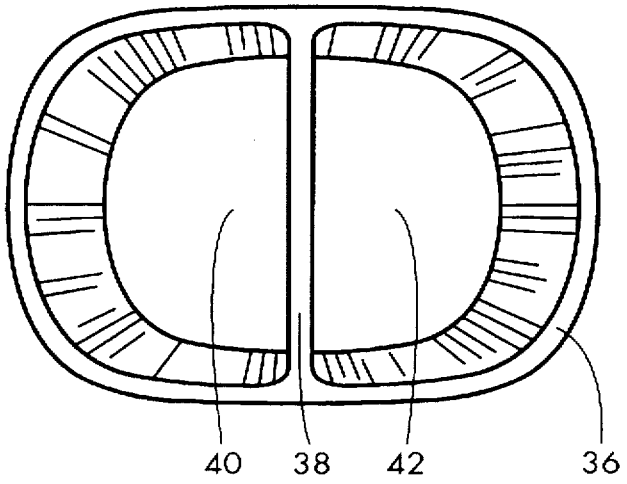

FIG. 7A shows a front view and 7B shows a perspective view of a similar clasp.

REFERENCE NUMERALS IN DRAWINGS

10 towel
12 binding
13 overlap
14 corner radius top
15 corner radius bottom
16 break radius top
17 break radius bottom
18 wipe area top
20 wipe area bottom
22 neck band section
25 transitional segment
26 inner band
26A inner band end
27 outer band
27A outer band end
30 conjunct
32 pocket
34 slit
36 rigid clasp body
38 rigid clasp partition
40 rigid clasp left opening
42 rigid clasp right opening

SUMMARY

In accordance with the present invention a specially-shaped towel with perimeter binding that is draped around the neck and held in place by passing the ends of the towel into a double-band clasp that can be slid up or down the lengths of the towel.

DESCRIPTION—FIGS. 1 TO 4

Figure 3:
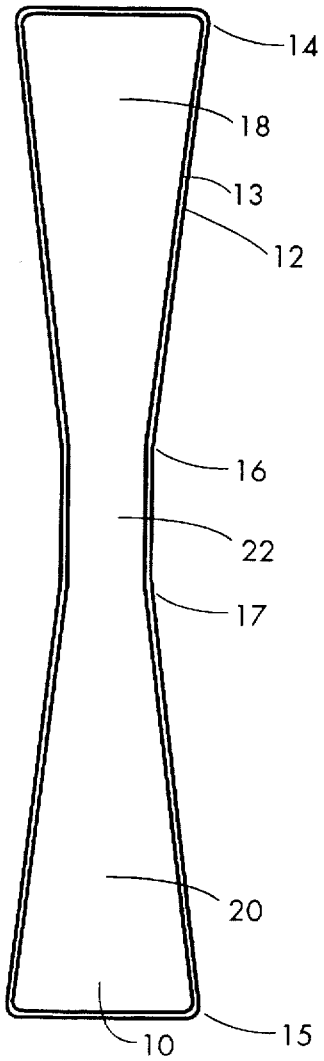
FIG. 3 shows the preferred shape and manufacture of the towel.
Figure 3A:
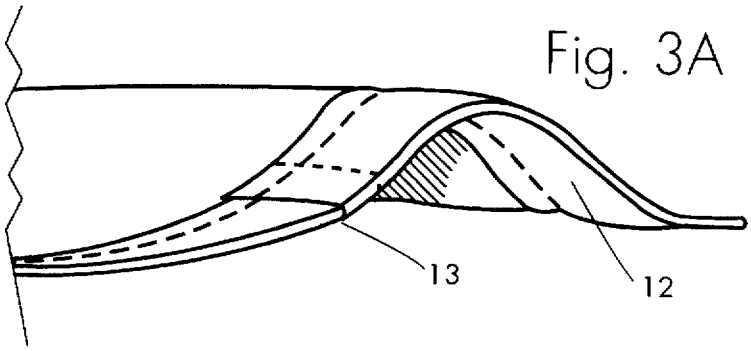
FIG. 3A shows a close-up view of the preferred towel's binding and overlap.
Figure 1:
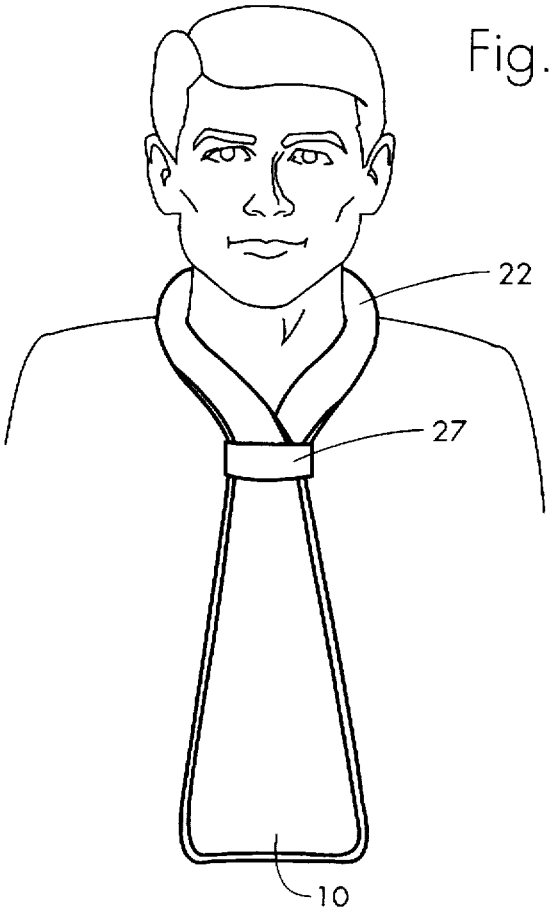
FIG. 1 shows the preferred neck towel and clasp.

The preferred embodiment of the neck towel and clasp assembly of the present invention is illustrated in FIG. 1, 2, 3, 4. FIG. 3 shows towel 10 cut to a predetermined shape from conventional woven-cotton terry towel material. The perimeter of the towel is covered or "edged" on both sides with a continuous length of 1.27 cm. (0.5 in.) wide white or colored-cotton binding 12 that has been folded over so that 0.635 cm. (0.25 in.) of binding is showing on each side of the towel. The binding is sewn in place using common thread and a conventional, continuous stitch that passes through both sides of the binding and towel and terminates about 3.81 cm. (1.5 in.) beyond overlap 13 which consists of one end of the binding overlapping the other end. Wipe area top 18 and wipe area bottom 20 begin respectively at break radius top 16 or break radius bottom 17 and extend to the respective extreme ends of the towel. Corner radius top 14 and corner radius bottom 15 are the same, and representative of other corners of the towel.

In the preferred embodiment shown in FIG. 3, the towel is 149.86 cm. (59 in.) in length and consists of a woven industry standard 13 or 14 ounce weighted cotton, either white or of a stock color. At the towel's extreme ends the width is about 27.94 cm. (11 in.) wide and at break radius 16 the towel tapers to about 12.065 cm. (4.75 in.) wide. Break radius bottom 17 is about 66.04 cm. (26 in.) from the extreme end of the towel which is just below corner radius bottom 15. The distance between break radius 16 and break radius 17 is about 17.78 cm. (7 in.). Break radius top 16 is about 66.04 cm. (26 in.) from the extreme end of the towel which is just above corner radius top 14.

Figure 4:
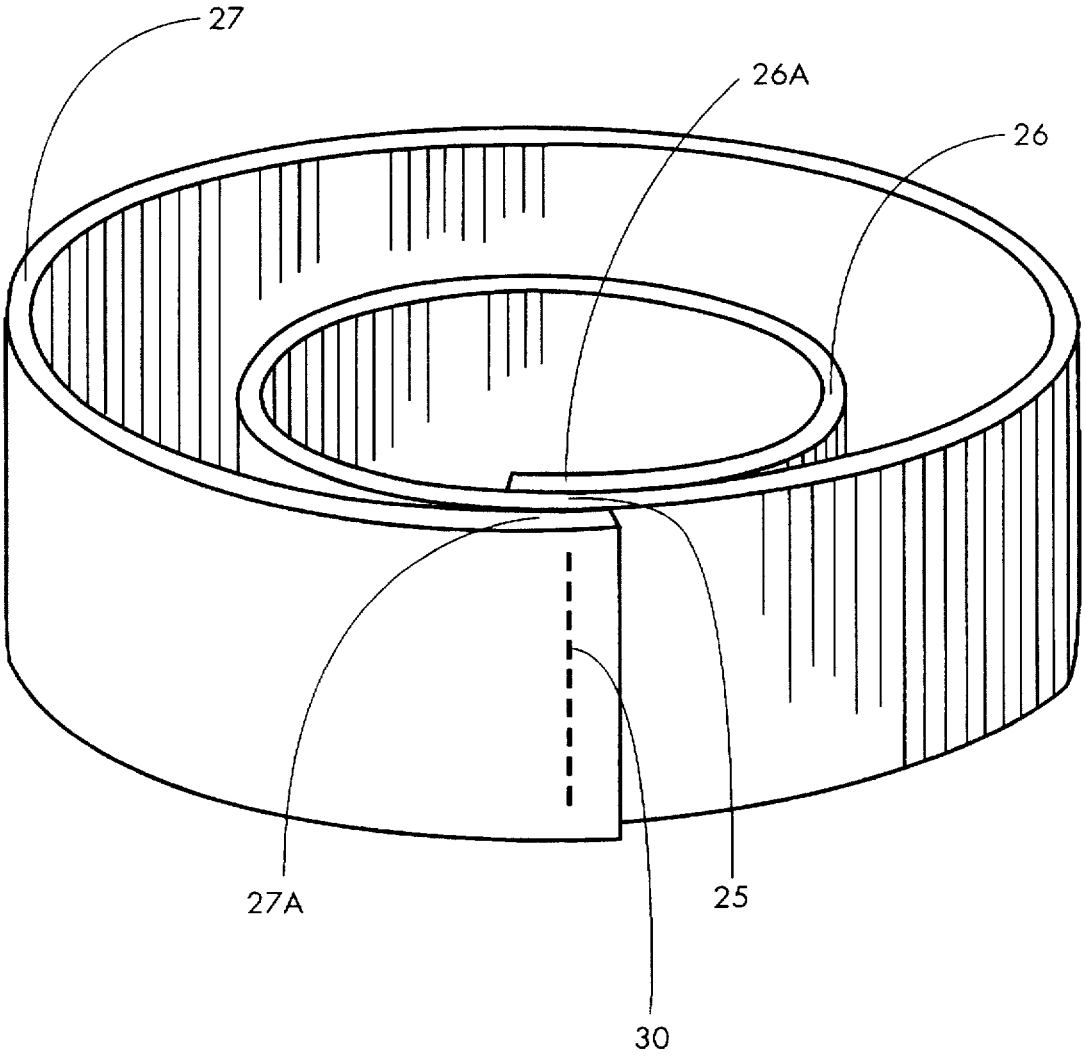
FIG. 4 shows the preferred shape and manufacture of the clasp.

In the preferred embodiment shown in FIG. 4, the clasp consists of the combination of outer band 27 having a diameter of about 7.62 cm. (3.0 in) and inner band 26 having a diameter of about 3.81 cm. (1.5 in.). The complete clasp consists of a length of 36.83 cm. (14.5 in.) nylon webbing that is 2.54 cm. (1.0 in.) wide which is wrapped in a circle to form inner band 26 and outer band 27. At conjunct 30 inner band end 26A and outer band end 27A and transitional segment 25 are fastened together. This fastening can be done by conventional sewing, heat staking, sonic welding or a grommet or rivet-like fastener can be used.

There are various possibilities with regard to the type, weight and dimensions of fabrics that are used to configure towel 10. Diameters of inner band 26 and outer band 27 may also vary depending upon the weight of material that is used in place of the towel and the dimensions of the neck band section and wipe areas. Webbing used for the clasp can be of made of various standard colors stocked by the supplier. Identification can be embroidered into the webbing or it can be silk screened or pad printed using methods commonly practiced by those skilled in the art.

Figure 5A:
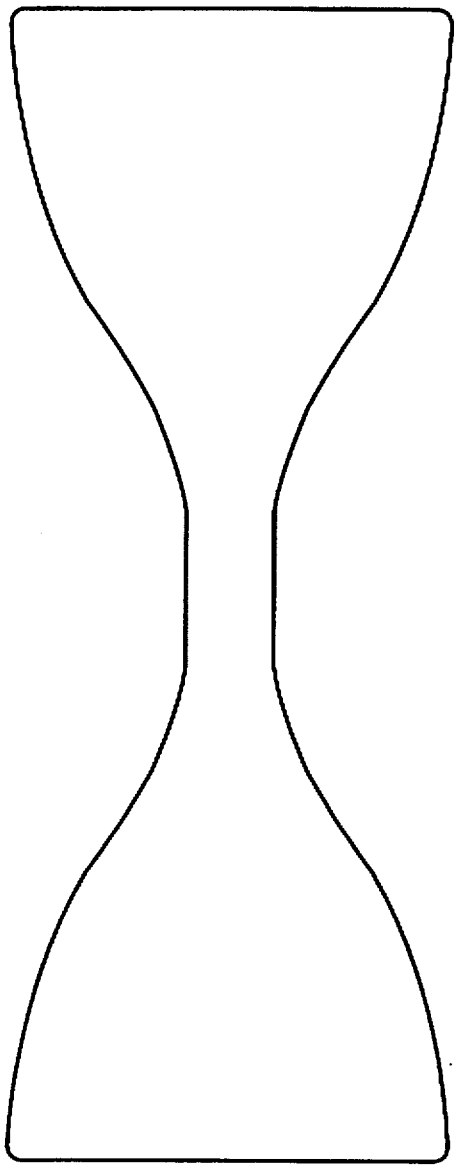
FIG. 5B shows a perspective view of another embodiment of a neck towel 5A.
Figure 5B:
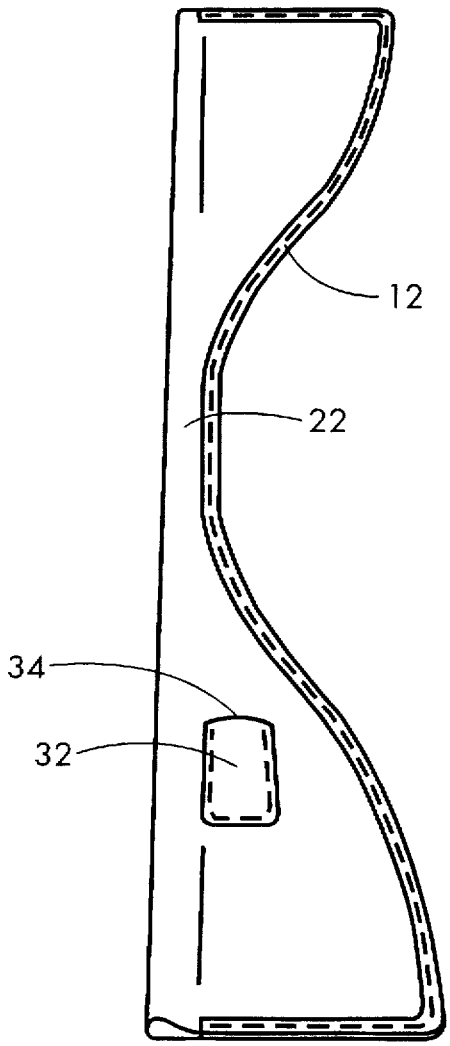

FIG. 5A shows a towel of similar shape to that of the preferred embodiment. Towel 5A is folded in half and only then is it fitted with binding 12 and sewn along the unfolded perimeter in a manner similar to that of the preferred embodiment. Pocket 32 with slit 34 is of conventional design and manufacture and is sewn on the towel just below the neck band section 22. The pocket can pass freely through either the inner band 26 or the outer band 27. The pocket can be presented on the underside of the towel, the side that is in contact with the user's chest, or it can be worn on the top side of the towel, the side shown when wearing the neck towel and clasp around the neck. The pocket can be used for conveniently retaining keys, cash and credit cards. The pocket's outer surface may be used for logo or name identification purposes.

FIG. 6B shows the possibility of a similar rectangular towel FIG. 6A that is folded in half at neck band section 22 and sewn together along binding 12.

Figure 7B:
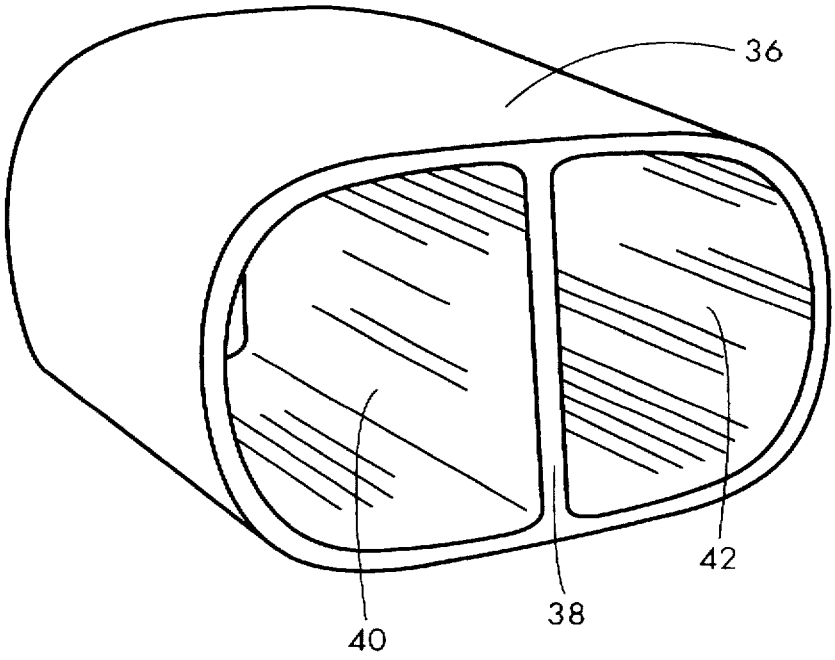

FIG. 7A, 7B shows the possibility of a similar rigid clasp body 36 that is comprised of rigid clasp partition 38 that forms rigid clasp left opening 40 and rigid clasp right opening 42. The rigid clasp body can be made from a number of materials that provide a slick surface which allows the clasp to slide freely when wrapped firmly around the neck towel. Polyethylene, polypropylene, or other plasticized materials could be used to manufacture the rigid clasp body. The least-cost method of manufacture would typically be to injection mold or cast the rigid clasp body using methods widely known by those skilled in the art. From the description above a number of advantages of my invention become evident:

(a) The simple design concept provides a low-cost solution for an adjustable neck towel that stays fast around the neck without encumbering the wearer's movement.

(b) The cost of labor to manufacture the clasp is contained, because the clasp can be made from a single length of off-the-shelf nylon webbing that can be easily formed using low-skilled labor.

(c) The towel, its binding, and the clasp can be produced in a wide variety of available colors.

(d) The combined towel and clasp can be laundered without having to separate the clasp from the towel, and this limits the possibility of losing the clasp in the process.

OPERATION—FIGS. 1, 2, 3, 4

Figure 2:
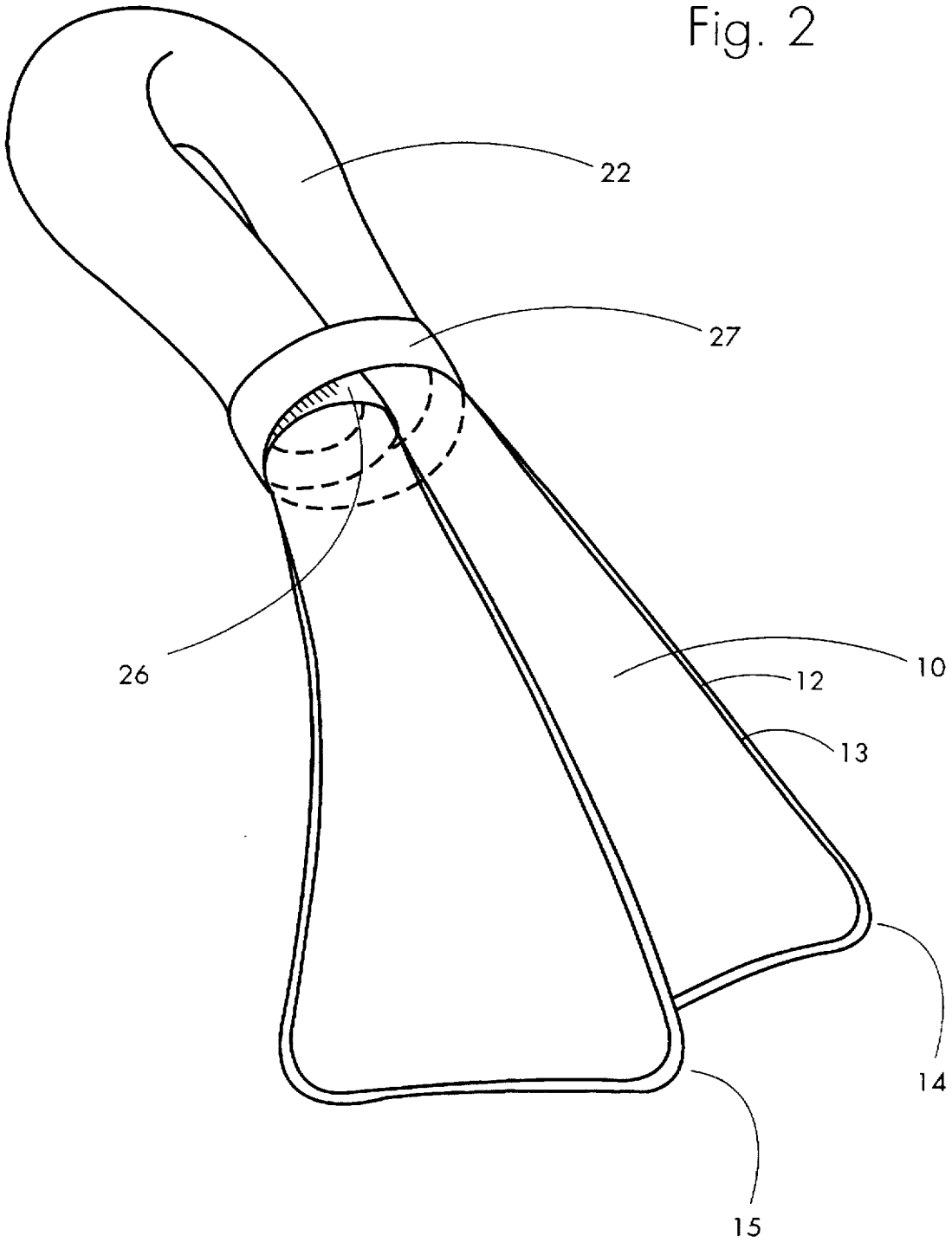
FIG. 2 shows operation of the preferred clasp.

The preferred manner of fastening a clasp comprised of inner band 26 and outer band 27 to towel 10 (FIG. 2) is to fasten prior to draping neck band section 22 around the neck. Fastening the clasp to the towel is accomplished by pulling corner radius bottom 15 through inner band 26 and corner radius top 14 through outer band 27 (FIGS. 2). The towel with clasp attached is fitted over the wearer's neck (FIG. 1) allowing neck band section 22 to fold naturally over and around the neck (FIGS. 1, 2) and the neck band section can thus be reduced or enlarged in size by pulling outer band 27 up or down wipe area bottom 20 and wipe area top 18.

SUMMARY, RAMIFICATIONS, AND SCOPE

My neck towel and clasp assembly invention provides a convenient way to carry a towel while engaged in sports or work activities. The specially-shaped towel can be adjusted to suit the wearer by sliding a clasp, comprised of an inner and outer band, up or down the lengths of the towel that are formed when it is draped around the neck. As a result of such adjustment, the neck band section of the towel, that section which encircles the neck, is reduced or enlarged to provide a comfortable fit around the neck, and because the towel is specially shaped it lays relatively flat across the chest where it does not encumber movement by the wearer. The neck band section also protects the back of the neck from sun burn. Since the towel stays on the wearer, it is less likely to collect debris and germs that can enter the wearer's eyes, nose and mouth.

The fitting of the towel to the wearer's neck can be accomplished in seconds and it can be readjusted to suit the wearer even while engaged in vigorous activity. The natural qualities of nylon webbing allow the clasp to move freely up or down the towel. Furthermore, the neck towel and clasp assembly have the additional advantage in that:

- it requires minimum fabrication.
- its clasp eliminates the use of rigid, cumbersome cast or molded parts.
- its clasp can be quickly fit to and removed from the towel.
- its clasp can be easily enhanced by embroidering, silk screening or pad printing identification on its outer surface.
- its towel can be easily enhanced by adding a pocket with or without embroidering, silk screening or pad printing of identification.
- it stays in place during rigorous activity without wearer discomfort.
- it can be washed with the clasp attached.
- it permits use of a wide variety of materials and colors.
- it can be made from off-the-shelf materials, thus lead times and inventory costs are minimized.
- it can be manufactured by low-skilled workers using widely available equipment.

Thus the reader will see that my neck towel and clasp assembly invention meets real needs currently being felt by sports enthusiasts and others who participate in activities that encourage facial sweating.

Although the description above contains many specificities, these should not be construed as limiting the scope of my invention, but as merely providing illustrations of some of the presently preferred embodiments of my neck towel and clasp assembly. The neck towel can be made from a number of fabrics which can be configured in a number of shapes to provide function as well as novelty. The binding can be eliminated by "serging" the perimeter of the towel. Serging creates a narrow band of tightly sewn material and it is a common method of limiting fraying of thread along edges that have been cut. The serging process is widely practiced by those skilled in the art. The clasp can be made from other materials that are pliable and have a slick surface that allows the clasp to slide freely when wrapped firmly around the neck towel. Polyethylene, polypropylene, vinyl, leather, various impregnated or laminated fibrous materials, and various plasticized materials could serve as a clasp material.

Thus the scope of my towel and clasp assembly should be determined by the appended claims and their legal equivalents, rather than by the examples given.

I claim:

1. A method for fastening a towel of predetermined shape around the neck of a human being and combining an adjustable clasp comprising the steps of:

(a) providing said towel of predetermined length, width and shape, and (b) sewing a fabric binding along perimeter of said towel, (c) providing said clasp consisting of a pliable material of predetermined length and width, and (d) wrapping said pliable material in a circle to form inner band having a predetermined diameter, and (e) continuing to wrap said pliable material forming a transitional segment and an outer band of predetermined diameter that encircles said inner band, and (f) bonding at conjunct the combination of said transitional segment with said inner band, and said outer band at a predetermined distance from inner band end and outer band end, (g) passing one end of said towel into said inner band and the other end of said towel into said outer band, which forms a neck band section which can be draped around the neck, and (h) moving said clasp up or down the length of said towel to enable enlargement or reduction of said neck band section.

2. A combination of a towel of predetermined shape for fastening around the neck of a human being and an adjustable clasp comprising:

(a) a towel of predetermined length, width and shape with binding sewn around the perimeter, (b) a clasp fastening means that combines an inner and an outer band, wherein said clasp is fastened to said towel by passing one end of said towel into said inner band and the other end of said towel into said outer band, and this fastening forms a neck band section which can be draped around the neck, and wherein said clasp can be conveniently moved up or down the length of said towel to enable enlargement or reduction of said neck band section.

* * * * *